United States Patent [19]

Lanham

[11] Patent Number: 4,858,834

[45] Date of Patent: Aug. 22, 1989

[54] CHIP SLICER IMPROVEMENT

[75] Inventor: Bryan Lanham, Gresham, Oreg.

[73] Assignee: Beloit Corporation, Beloit, Wis.

[21] Appl. No.: 307,217

[22] Filed: Feb. 3, 1989

Related U.S. Application Data

[63] Continuation of Ser. No. 142,623, Jan. 11, 1988, abandoned.

[51] Int. Cl.[4] ..... B02C 19/12

[52] U.S. Cl. ..... 241/85; 241/28; 241/86.1; 241/89.3; 241/229

[58] Field of Search ..... 144/163, 174; 241/28, 241/86.1, 89.3, 85, 87, 88.1, 228, 229, 246, 247

[56] References Cited

U.S. PATENT DOCUMENTS 3,549,093 12/1970 Pallman .

4,235,382 11/1980 Smith ..... 241/28

4,253,613 3/1981 Reinhall ..... 241/28 X 4,260,113 4/1981 Maier et al. ..... 241/28

*Primary Examiner*—Mark Rosenbaum

*Attorney, Agent, or Firm*—Dirk J. Veneman; Raymond W. Campbell

[57] ABSTRACT

Apparatus and a process for use in preparing pulp for papermaking and particularly the preparation of wood chips including a rotary anvil with vanes forcing wood against a cutting knife and an infeed chute directing wood into the radial interior of the rotary anvil positioned to center the wood with respect to the anvil vanes with an additional stationary guide to center the infed wood and stationary guide deflectors on the anvil vanes further directing the wood toward the center of the anvil vanes for centering the load axially on the rotary anvil.

8 Claims, 1 Drawing Sheet

CHIP SLICER IMPROVEMENT

BACKGROUND OF THE INVENTION

This is a continuation of application Ser. No. 42,623 filed on Jan. 11, 1988, now abandoned.

The invention relates to improvements in methods and apparatus for preparing wood in the process of preparation of pulp for papermaking and particularly in the preparation of wood chips.

In the paper industry, wood pulp is made by subjecting wood chips to a chemical digestion process wherein the compounds and chemical systems holding the fibers together, such as lignin, are dissolved to thereby liberate the individual wood fibers which are then diluted with water and introduced into a papermaking machine to make paper or paperboard products. The preparation of the wood chips is a critical part of the process in that, ideally, the wood chips should be of uniform thickness so that the chemicals penetrate the chips equally during the digestion process. If not properly formed, the chips may not be sufficiently penetrated to liberate the wood fibers, or if the chips are too thin, the chemicals may penetrate the chips too rapidly or for a longer time than necessary to liberate the individual fibers. The fibers themselves may be deleteriously weakened, or shortened or both.

The thickness of the individual wood chips is defined in the direction extending radially relative to the longitudinal axis of the log. Control of cutting the chips is difficult since the chips are sometimes gouged or broken out in chunks as the result of knots and compression. To ensure consistent chip size, screening systems are used to separate out oversize chips, which are directed to apparatus for reducing the size of the chips. Commercial type wood rechippers take various forms, and one successful form has been a rotary rechipper or chip slicer having a drum in which a rotor with vanes carries the wood in a rotary path to force the wood against knives circumferentially placed around the rotor. The rotor carries anvil vanes and rotates at a controllable speed on the order of 200 to 1000 rpm. As the wood is fed near the center of the anvil and enters the spaces between the rotor vanes, the wood is impacted by the vanes, preventing it from entering further into the length of the drum and is forced radially against the knives. Unless the wood is centered axially along the rotary anvil, uneven loading along the length of the drum occurs so that the drum is heavily loaded in the front or entry side and lightly loaded at the rear side, when viewing the rotary anvil with respect to its axial load. The nonuniform axial loading of the anvil contributes to nonuniformity in chip quality or size and tends to reduce the quality of the pulp produced. A need exists to produce chips of maximum uniformity and to minimize fines generated by chip slicing equipment. Wider slicers have been utilized to achieve more uniform chips, but higher wear and lower capacities than expected have resulted. This is due to a large extent upon nonuniform loading in an axial direction and this problem also exists on narrow units as well, but to a lesser degree.

It is accordingly an object of the present invention to provide an apparatus and method utilizing a rotary chip slicer which is capable of producing more uniform chips and is capable of long periods of operation without repair or adjustment.

A further object of the invention is to provide a chip slicer which has higher wear capability and higher capacity than heretofore available.

A still further object of the invention is to provide a rotary chip slicer for the production of wood chips in a pulping process wherein an axial anvil type rotor is used for slicing the chips and a uniform axial load is attained along the length of the rotary anvil making it possible to use a wider or longer anvil than heretofore available.

FEATURES OF THE INVENTION

In utilizing a rotary rechipper or chip slicer for the production of wood chips, such as shown for example in U.S. Pat. No. 4,235,382, it has been determined that the location and shape of the infeed chute for feeding the wood into the center of the rotary anvil is critical. If the chute is located in a position which will introduce the wood nonuniformly relative to the anvil, an uneven load of wood chips in an axial direction will occur causing localized wear and nonuniformity of chip production. Accordingly, the infeed chute is positioned critically at the axial center of the anvil rotor, and, additionally, a stationary deflector is provided which enhances the distribution and location of the infeed of the wood to the center of the rotary anvil. Additionally, stationary deflectors are added to the rotary vanes of the anvil to further aid in the distribution and centering of the wood in an axial direction relative to the rotary anvil. The rotor is designed so that it allows presentation of the wood onto it at a point mid-point of the axial rotor width.

Other objects, advantages and features will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
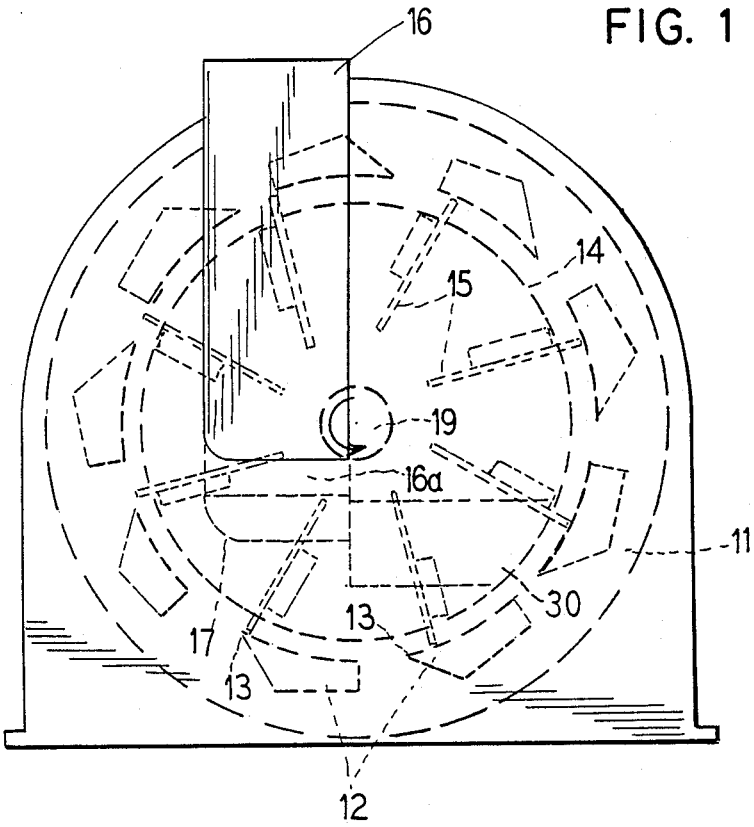
FIG. 1 is an elevational view with portions shown in dotted line phantom view of a rotary chip slicer constructed and operating in accordance with the principles of the present invention.
Figure 2:
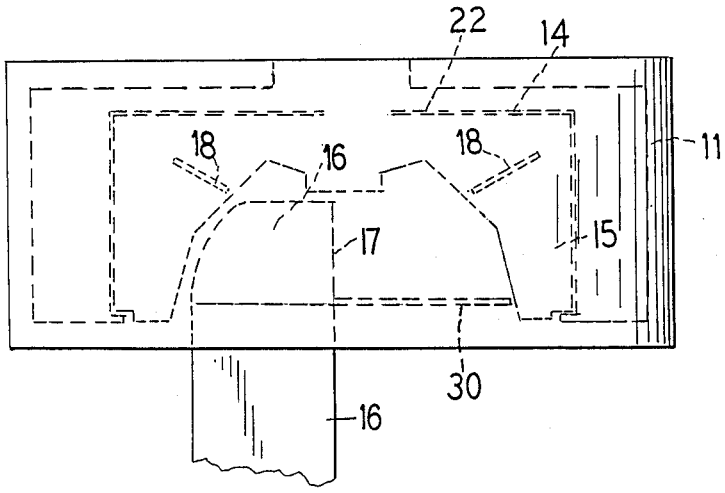
FIG. 2 is a plan view taken from the top of FIG. 1, illustrating the structure of FIG. 1.

The drawing figures illustrate a chip slicer with a cylindrical housing 11 providing a chamber therein wherein wood chips are recut. For cutting the chips, a plurality of knives 12 are mounted arranged circumferentially around and within the housing having leading cutting edges 13 so that the wood is carried around in a counter-clockwise direction, as shown in FIG. 1 to be brought against the knives. Various arrangements may be used for controlling the size of the chips, such as adjustment on the knives, and adjustment may be provided for slots in advance of the knives. Such mechanism will be recognized by those versed in the art and need not be described in detail. For example, a form of chip slicer is shown wherein the knives are mounted on slots in the aforementioned U.S. Pat. No. 4,235,382.

Figure 3:
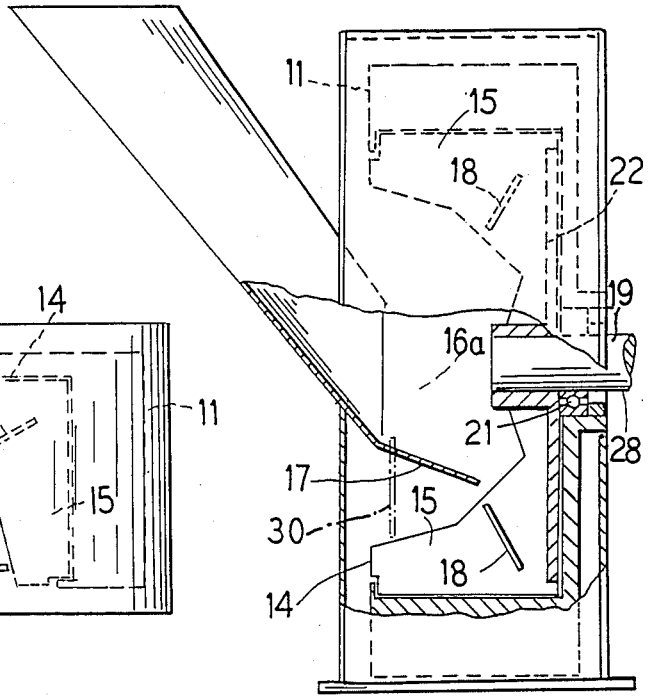
FIG. 3 is a side elevational view of the mechanism of FIG. 1, with portions broken away, to illustrate the interior structure.

Within the cylindrical drum 11 is a rotary anvil 14 which is mounted on a drive shaft 19. The drive shaft is shown supported on bearings 21 in FIG. 3. with means for driving it in rotation shown schematically by the arrowed line 20. In the arrangement illustrated in the drawings, a stationary arrangement is provided for the knives although, in some cases, it may be desirable to use a rotary cylinder for carrying the knives wherein the knives are rotated in the same direction and at a speed different than the center anvil 14.

The anvil has vanes 15 which are mounted on a hub or base 22 carried on the shaft 19 and which extend axially and radially. The vanes 15 are shaped so that they provide an opening at their circumferential center for delivery of wood into the center of the vanes 15. Wood is delivered by a chute 16 which is positioned so that its delivery end 16*a* is axially centered relative to the rotary anvil 14. The purpose of this is to deliver the wood to the axial center of the anvil so that the load of the chips is uniformly distributed in an axial direction.

For further aiding in the centering of the distribution of the incoming wood to be chipped, a fixed stationary vane 17 is provided which aids in guiding the wood to the center of the rotary anvil 14.

Further, each of the vanes 15 carries on it one or more deflectors 18 which project directly out from the vane of the anvil and which additionally extend at an angle to a plane which is at right angles to the axis of the rotary anvil 14. These vanes are positioned on a leading face of the anvil with respect to its direction of rotation, and this position, as well as their angular location, further tends to distribute and direct the wood relative to the axial center of the rotary anvil.

In operation, wood is delivered through the chute 16 to the outlet end 16a in the axial center of the rotary anvil 14. Further guidance to the wood is provided by the fixed vanes 17. With rotation of the anvil, the angled deflectors 18 further distribute and guide the wood relative to the axial center of the rotor so as to create a uniform axial load on the rotary anvil as well as to distribute the load uniformly across the axial length for improved chipping.

After leaving the fixed vane 17, further chips guidance can be provided by secondary fixed vane 30. Further axial movement of wood chips is controlled by vane 30 until centrifugal force moves the chips into rotating vanes 15.

While specific embodiments of an improvement for chip slicers have been shown and described in detail herein, various changes may be made without departing from the scope of the present invention.

I claim:

1. An apparatus for slicing wood chips for reducing the thickness dimension thereof, said device comprising:

a substantially cylindrical housing having a plurality of knives circumferentially disposed around and within the housing, said knives having cutting edges exposed to chips passed along the inner surface of said housing;

said housing having an axial dimension between a first end of said housing and a second end of said housing;

a rotary anvil means for carrying wood chips against said cutting edges, said rotary anvil means having a rotary anvil axial width and being rotational about an axis of said rotary anvil means;

said rotary anvil means having a base disposed substantially at said first end of said cylindrical housing and having a plurality of vanes for carrying wood chips radially toward and circumferentially against said cutting edges, said vanes extending radially from near said axis of said rotary anvil means and housing and extending axially and radially from said base toward said second end of said housing;

said base and said vanes thereby defining a generally frusto-conically shaped chip receiving area of greater diameter near second end of said housing than near said first end of said housing, and substantially closed at said first end by said base;

an infeed chute means for supplying wood chips to said rotary anvil means, said infeed chute means having a delivery end disposed within the rotary anvil axial width so that chips leaving said delivery end are deposited in said chip receiving area of said rotary anvil means near the center of the rotary anvil axial width and near said axis about which said rotary anvil means is rotational; and said vanes thereby receiving chips from said infeed chute means and distributing the chips radially and axially to evenly distribute the load against said cutting edges as the chips are brought into cutting inter-engagement with said knife means.

2. An apparatus for slicing wood chips as defined in claim 1, in which a stationary guide means is mounted on the delivery end of said chute means, said stationary guide means being o a shape to complement the shape of said generally frusto-conically shaped chip receiving area, for directing the deposit of infeed wood chips toward the axial center of said rotary anvil means.

3. An apparatus of slicing wood chips as defined in claim 1, in which a guide means is disposed on said rotary anvil means and is rotational therewith to further direct the wood chips deposited at the center of the rotary anvil axial width.

4. An apparatus for slicing wood chips as defined in claim 3, i which stationary guide means are mounted on the delivery end of said chute means, said stationary guide being of a shape to correspond to the shape of said chip receiving area, for directing the deposit of infeed wood chips toward the axial center of said rotary anvil means.

5. A wood chip slicing apparatus for the preparation of chips in the process of preparing pulp for papermaking, comprising in combination:

a cylindrical drum adapted to be rotated about its longitudinal axis and having a wall including a plurality of segments defining a corresponding plurality of slots in the wall, with said slots extending substantially axially along the drum wall, and said drum having a plurality of knives with each knife mounted in a wall segment;

a generally bowl-shaped anvil rotor having a rotor base and a rotor side, said rotor having a plurality of arms on each of which an anvil is mounted, with said anvil rotor having an axial width substantially defined by said anvils and being adapted to be rotated concentrically within the drum; said anvil rotor base being a body substantially closing said bowl shaped rotor at a bowl bottom, said arms extending axially and radially to define bowl sides, with spaces between said anvils at said rotor side for exposing chips at said rotor side to said plurality of knives;

means for rotating the anvil rotor and the drum in the same direction about a common rotational axis at different rotational speeds, with the anvil rotor speed being greater than the drum speed whereby wood is forced past knife to cut a chip; and an infeed chute for supplying wood to said bowl-shaped rotary anvil, with the delivery end of the chute being radially within the anvil rotor axial width and positioned substantially axially with respect to the anvil rotor axial width so that chips falling from said delivery end are delivered to the center of the axial width near said rotational axis, whereby said rotor distributes the chips radially and axially for interengagement with said knives.

6. A wood chip slicing apparatus for the preparation of chips in the process of preparing pulp for papermaking constructed in accordance with claim 5:

wherein each of said anvils has a stationary deflector for directing wood toward the center of the anvil rotor axial width.

7. A wood chip slicing apparatus for the preparation of chips in the process of preparing pulp for papermaking constructed in accordance with claim 5 in which said delivery end of said infeed chute is shaped to correspond to the shape of said bowl sides.

8. A wood chip slicing apparatus for the preparation of chips in the process of preparing pulp for papermaking constructed in accordance with claim 7:

wherein each of said anvils has a stationary deflector for directing wood toward the center of the anvil rotor axial width.

* * * * *